US008720539B2

(12) United States Patent
Patterson, II et al.

(10) Patent No.: US 8,720,539 B2
(45) Date of Patent: May 13, 2014

(54) MODULAR POWER SOURCE FOR SUBSURFACE SYSTEMS

(75) Inventors: Albert E. Patterson, II, Richmond, TX (US); Colin Longfield, Houston, TX (US); Shardul J. Sarhad, Stafford, TX (US); Patrick J. Fisseler, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/679,674

(22) PCT Filed: Sep. 18, 2008

(86) PCT No.: PCT/US2008/076866

§ 371 (c)(1),
(2), (4) Date: Aug. 20, 2010

(87) PCT Pub. No.: WO2009/042494

PCT Pub. Date: Apr. 2, 2009

(65) Prior Publication Data

US 2010/0300677 A1 Dec. 2, 2010

Related U.S. Application Data

(60) Provisional application No. 60/975,600, filed on Sep. 27, 2007.

(51) Int. Cl.
*E21B 4/04* (2006.01)

(52) U.S. Cl.
USPC ..... 166/65.1; 175/40

(58) Field of Classification Search
USPC ..... 166/65.1; 175/40
See application file for complete search history.

(56) References Cited

U.S. PATENT DOCUMENTS

| | | | | |
|---|---|---|---|---|
| 4,936,139 | A | 6/1990 | Zimmerman et al. | |
| 5,064,006 | A * | 11/1991 | Waters et al. | 175/45 |
| 5,265,682 | A | 11/1993 | Russell et al. | |
| 5,517,464 | A | 5/1996 | Lerner et al. | |
| 5,793,625 | A | 8/1998 | Balogh | |
| 5,883,516 | A * | 3/1999 | Van Steenwyk et al. | 324/366 |
| 6,084,052 | A | 7/2000 | Aufdermarsh et al. | |
| 6,105,690 | A * | 8/2000 | Biglin et al. | 175/48 |
| 6,187,469 | B1 | 2/2001 | Marincic et al. | |
| 6,300,762 | B1 | 10/2001 | Thomas, Jr. et al. | |
| 6,575,248 | B2 | 6/2003 | Zhang et al. | |
| 6,577,244 | B1 | 6/2003 | Clark et al. | |
| 6,649,906 | B2 | 11/2003 | Adolph et al. | |
| 7,124,819 | B2 | 10/2006 | Ciglenec et al. | |
| 2005/0016769 | A1 * | 1/2005 | Wallace | 175/40 |
| 2005/0087368 | A1 * | 4/2005 | Boyle et al. | 175/57 |
| 2006/0260805 | A1 | 11/2006 | Longfield | |
| 2006/0283606 | A1 | 12/2006 | Partouche et al. | |

* cited by examiner

*Primary Examiner* — Brad Harcourt
(74) *Attorney, Agent, or Firm* — Cathy Hewitt; John Vereb

(57) ABSTRACT

An electrical power system comprising a support configured for interconnection within a subsurface drillstring, an electrical power unit coupled to the support, and a conductive link configured to distribute electrical power from the electrical power unit to at least one component coupled to the electrical power system within the subsurface drillstring.

17 Claims, 6 Drawing Sheets

MODULAR POWER SOURCE FOR SUBSURFACE SYSTEMS

BACKGROUND

Exploration, production, and monitoring of hydrocarbon and water deposits entails the measurement of subsurface characteristics and the evaluation of the obtained data to determine petrophysical properties of interest for the relevant formation or reservoir. A variety of techniques have been developed to measure subsurface characteristics. These techniques involve the subsurface deployment (usually through a borehole traversing the formations) of several different measurement and telemetry systems to provide data regarding the subsurface characteristics of interest, and data regarding the state of tools or instruments disposed downhole.

Among the various data collection and logging techniques routinely employed, systems for obtaining measurement data while drilling have proven to be cost effective. Logging While Drilling (LWD) and Measurement While Drilling (MWD) techniques are well known in the art. Logging While Tripping (LWT) systems have also been developed as an alternative to LWD and MWD techniques. In LWT, a small diameter "run-in" tool is sent downhole through the drill pipe, at the end of a bit run, just before the drill pipe is pulled. The run-in tool is used to measure downhole characteristics as the drill string is extracted or tripped out of the hole. In these types of systems, obtained data is either stored in downhole memory for later processing or transmitted to the surface using telemetry means, such as mud flow telemetry devices in the case of LWD/MWD systems.

Regardless of the conveyance means used for downhole tools, a shared requirement of the various measurement and telemetry systems is the need for electrical power. With the exception of wireline systems, it is difficult to convey electric power from the surface through the conveyance means to the components of the logging tools or the telemetry means. In these cases, electrical power can however be provided by downhole sources. Conventional systems obtain such power downhole either from a battery pack or a turbine-based alternator. Battery packs provide an energy storage medium. When using batteries, electrical power is made available until the battery is depleted. Turbine-based alternators provide an energy conversion device. In this case, electrical power is made available only when the energy source to be converted into electrical power is present.

Examples of alternators used in downhole logging tools are described in U.S. Pat. Nos. 5,517,464 and 5,793,625. An example of an alternator-like electrical torque-generator is described in U.S. Pat. No. 5,265,682. Turbine-based alternators employ rotors having impellers that are placed in the high-pressure flow of drilling fluid ("mud flow") inside the drill string so that the impeller blades convert the hydraulic energy of the drilling fluid into rotation of the rotor. The rotor rotates at an angular velocity that provides enough energy to power the telemetry means and/or other components (e.g., sources/sensors) in the telemetry tool, and in some cases other tools in the downhole assembly.

Examples of battery packs used in downhole logging tools are described in U.S. Pat. Nos. 6,187,469 and 6,575,248. An example of a testing while drilling tool powered at least in part by a battery module disposed in the tool collar is described in U.S. Pat. No. 7,124,819 (assigned to the present assignee and entirely incorporated herein by reference). Battery packs are charged at the surface and provide electrical power to a single tool. Some batteries packs may be recharged downhole.

FIG. 1 shows a conventional land-based drilling rig 10 with connected drill pipe leading into a borehole 12 drilling through a subterranean formation F. At the tip of the drill string 14 is a drill bit 16 followed by a bottom hole assembly (BHA) 18 comprised of drilling, telemetry, and MWD/LWD tools. The borehole 12 is formed by rotary drilling in a manner that is well known. Drilling fluid or mud is pumped to the interior of drill string 14 to flow downwardly through the string. The drilling fluid exits drill string 14 via ports in the drill bit 16, and then circulates upwardly through the annular space between the outside of the drill string and the wall of the borehole as indicated by the arrows. These conventional systems are powered both in a distributed fashion, wherein an individual tool in the string contains its own battery, and in a centralized fashion, wherein an individual tool draws power from a downhole turbine.

FIG. 2 shows a conventional design for supplying power in a downhole system such as the drilling assembly of FIG. 1. Each tool in the BHA has its own dedicated battery 20. A single conductor, combined low electrical power and low speed communications bus 22 is used through all tools in the string. A low electrical power source is provided by a turbine, usually disposed in the telemetry tool, and energized by the mud flow. It should be appreciated that the bus 22 does not provide electrical coupling between the battery disposed in one tool and electrical components disposed in another tool. This configuration offers restricted spacing (a large spacing) between sources/sensors 24 in the string and presents handling and reliability issues. Thus a need remains for improved power distribution techniques for subsurface systems.

SUMMARY

The present disclosure provides a flexible architecture and modular method of supplying power to downhole tools and instruments. Aspects of the disclosure include a modular power sub to supply the power needs for downhole tools in a centralized manner in which a single power source can be used to simplify the BHA by removing the need for a power source in each tool or component in an assembly. The power subs disclosed herein provide more power in a flexible manner, such as to cover both flow and no flow measurements in while-drilling applications. In addition, it is also contemplated that the BHA may include one or more power subs, optionally with varying power outputs, which may provide the BHA with additional flexibility and modularity. For example, the BHA may be stacked with multiple power subs, running in series or parallel, that provide the BHA with additional or greater power. One potential benefit is to provide a more compact BHA, where the location of the power sub can be customized as desired for any drilling operation. An additional potential benefit of having power subs is that a frame of the power sub (e.g. a chassis and/or collar) may be used with a plurality of tools/BHAs, thereby reducing the inventory and design time associated with storing and/or designing frames for the various tools. Another potential benefit of centralizing and sharing the power sources amongst the tools of the BHA is to prevent failure of one particular tool caused for example by the depletion of its battery. In the proposed configurations, all tools of the BHA may be simultaneously powered and provide useful measurements as long as the centralized power source is available. While the failure of a single tool does not usually justify the end of the drilling operation, the depletion of a centralized power source may justify the end of the drilling operation. In this case however, the end of the drilling operation occurs at a time where an optimal use of the downhole power has been achieved.

Other aspects of the disclosure include a modular downhole tool having a measuring or testing section disposed in one tool collar and a modular power sub disposed in another tool collar. For example, during high temperature logging runs, which may expose the battery or any other component in the power sub to unacceptably high temperatures, the modular power sub may be removed from the tool and replaced with another modular power sub having a higher temperature rating, such as a turbine. Thus, the downhole tool may be equipped with any of a plurality of power subs having varying power outputs, thereby allowing the downhole tool to be configured with different electrical power configurations. An additional potential advantage provided by this configuration is that the measuring/testing section and the modular power sub of the downhole tool can be handled separately, thereby providing more compact collars (e.g. shorter than thirty five feet and/or lighter than four thousand five hundred pounds). Short collars are easier to transport to and from a drilling rig and easier to assemble to the BHA.

One embodiment introduced in the present disclosure provides an electrical power system comprising a support configured for interconnection within a subsurface drillstring, an electrical power unit coupled to the support, and a conductive link configured to distribute electrical power from the electrical power unit to at least one component coupled to the electrical power system within the subsurface drillstring. The support may comprise a drill collar and a central chassis internally coupled to the drill collar. The support may also comprise an annular space between the drill collar and the central chassis, wherein the annular space is configured to allow mud flow to or from the at least one component coupled to the electrical power system within the subsurface drillstring. The central chassis may comprise a first conductor, at least one power source, at least one electronics component, and a second conductor, wherein the at least one power source and the at least one electronics component are each coupled between the first and second conductors. The conductive link may be coupled, at least indirectly, to at least one of the first and second conductors. The conductive link may comprise at least one of the first and second conductors. One of the first and second conductors may comprise a pin conductor and the other of the first and second conductors may comprise a box conductor. The conductive link may comprise at least one multiple conductor member. For example, the conductive link may comprise a plurality of electrical conductors, including at least one first conductor configured for distributing high power and at least one second conductor configured for distributing communications. The plurality of electrical conductors may also include at least two first conductors configured for distributing high power and at least two second conductors configured for distributing communications.

The present disclosure also introduces a modular power system for a downhole tool, comprising a tool collar configured to operatively connect to a BHA, wherein the BHA comprises a plurality of BHA components; an electrical power source disposed in the tool collar and configured to provide electrical power to at least one of the plurality of BHA components; and a connector disposed between the electrical power source and one of the plurality of BHA components. The plurality of BHA components may include at least one drilling component, at least one telemetry component, at least one measurement-while-drilling (MWD) component, and/or at least one logging-while-drilling (LWD) component. The plurality of BHA components may not comprise any internal electrical power source and, thus, may only be powered by the electrical power source. The electrical power source may comprise an energy storage medium, including where none of the BHA components comprise an energy storage medium. The electrical power source may additionally or alternatively comprise an energy conversion device, including where none of the BHA components comprise an energy storage medium. The electrical power source may comprise an energy storage medium which is rechargeable downhole and/or at the surface.

The present disclosure also provides a modular drilling tool having a drill bit at and end thereof, comprising: a first collar including at least portions of a testing module; a second collar including at least portions of a telemetry module; and a third collar including an electrical power source operatively connected to the testing module; wherein removal of the third collar reduces a length of the tool.

DETAILED DESCRIPTION

Figure 1:
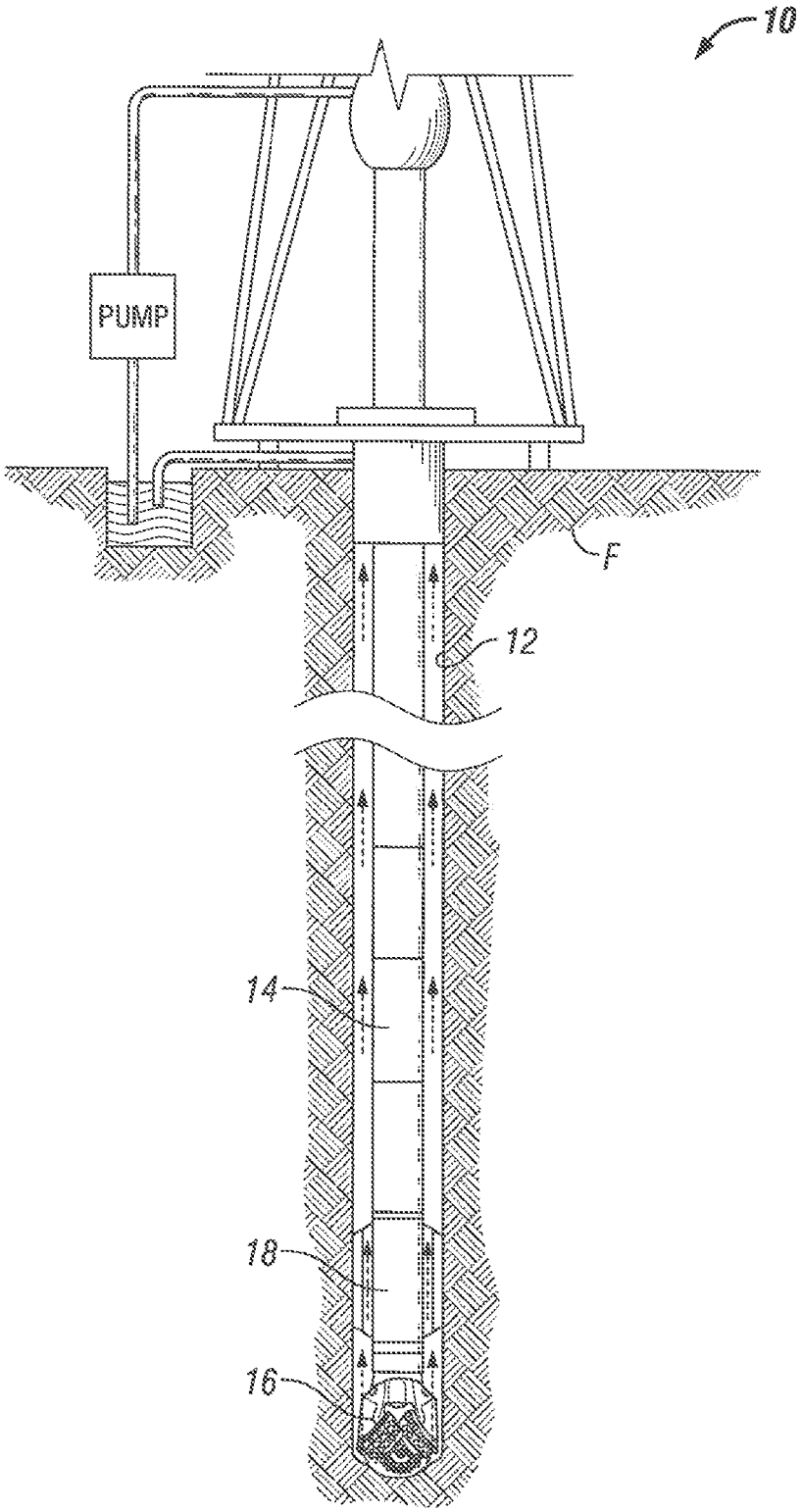
FIG. 1 (Prior Art)
FIG. 1 is a schematic view of drilling apparatus according to the prior art.
Figure 2:
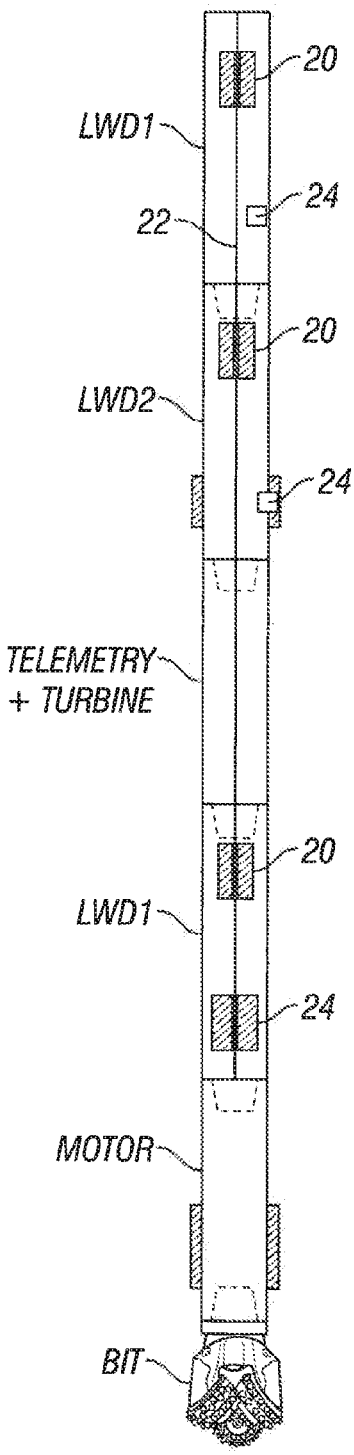
FIG. 2 (Prior Art)
FIG. 2 is a schematic view of a bottom hole assembly (BHA) according to the prior art.
Figure 3:
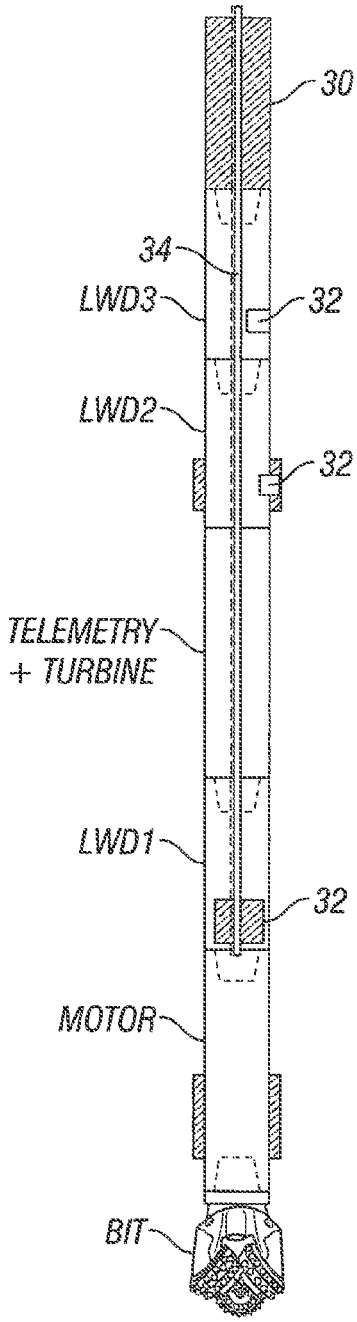
FIG. 3 is a schematic view of a BHA according to one or more aspects of the present disclosure.

FIG. 3 is a schematic view showing aspects of the present disclosure. This system configuration includes a centralized power scheme where a modular power sub 30 is disposed in the assembly. With a power section no longer required in each tool, their complexity and length decreases significantly. This in turn moves all of the measurements taken by these tools closer together (e.g., reduced spacing between sources/sensors 32) and to the drill bit. The close proximity to the bit creates a major advantage in well trajectory decision making as the well profile can be more precisely controlled with the measurements closer to the bit. In addition to the centralized power, a multiple conductor, high power and communications bus 34 is disposed in the string. Multiple conductors are preferable to maximize both the power transmission and the telemetry data rate. Also, while the tools shown in FIG. 2 have a dedicated power source and hence may still be operative in case of a failure of the single conductor bus 22, the bus 34 preferably provides redundant electrical paths between the modular power sub 30 and the tools in the BHA to minimize the impact of the failure of one of the paths in the bus 34. Although aspects of the modular power sub 30 disclosed herein are shown powering the tools of a drill string BHA, one skilled in the art given the benefit of this disclosure will appreciate that the present disclosure is not limited solely to drilling applications.

Figure 4:
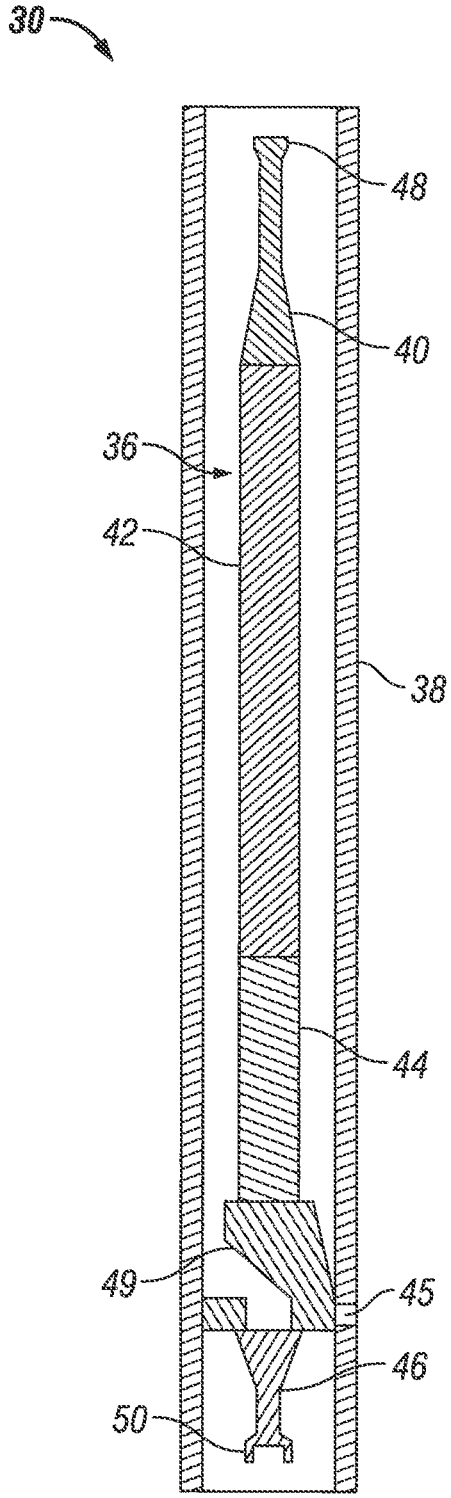
FIG. 4 is a schematic view of a power sub according to one or more aspects of the present disclosure.

FIG. 4 is a schematic view showing aspects of a modular power sub 30 of the present disclosure. A central chassis 36 resides inside a main drill collar 38 which withstands all of the drilling forces. The illustrated configuration allows mud flow within the annular space between the drill collar 38 and the chassis 36. However, other configurations within the scope of the present disclosure may have the mud flow through a central channel (not shown) within the chassis 36. Additionally, other aspects may be implemented with the chassis 36 offset from center of the collar 38.

The chassis 36 may be comprised of four main components, such as an upper conductor 40, a power unit/source 42, electronics 44, and a lower conductor 46. The upper 40 and lower 46 conductors route power and communication to and from the power sub 30.

Figure 5:
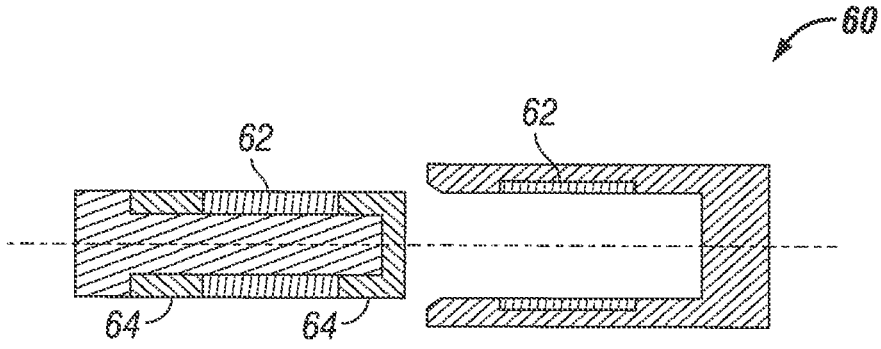
FIG. 5 (Prior Art)
FIG. 5 is a schematic view of an electrical connector according to the prior art.

The upper conductor 40 comprises a pin connector 48 and the lower conductor 46 comprises and a box connector 50. It will be understood that aspects of the power sub 30 can be implemented with the pin and box connectors transposed (i.e., pin at lower position, box at upper position). FIG. 5 shows a conventional connector pair 60. This connector has a single-contact 62 configuration with seals 64. Although conventional connectors may be used, aspects of the present disclosure are not limited to any particular connector design. Furthermore, the connector may be implemented in the collar wall, as known in the art.

Figure 6:
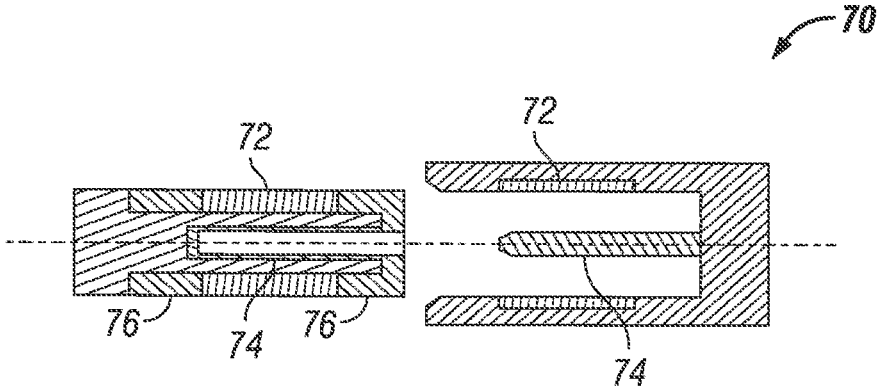
FIG. 6 is a schematic view of an electrical connector according to one or more aspects of the present disclosure.

Turning to FIG. 6, another aspect of a connector pair 70 of the present disclosure is shown. The connector pair 70 of FIG. 6 is configured with a mating pair of dual contacts 72, 74. Two or more contacts allow for efficient transmission of both power and communication. This connector pair maximizes contact length while minimizing the overall engagement length of the connector so as to easily fit within the envelope of a tapered drill collar thread connection. The short path between the connectors is also maximized and elastomeric seals 76 are used to isolate the connections. The radial arrangement of the smaller box socket comprising contacts 74 within the large pin could be expanded beyond two conductors as shown to three conductors and beyond. Any suitable materials may be used to implement the connector pairs of the present disclosure as known in the art.

Figure 7:
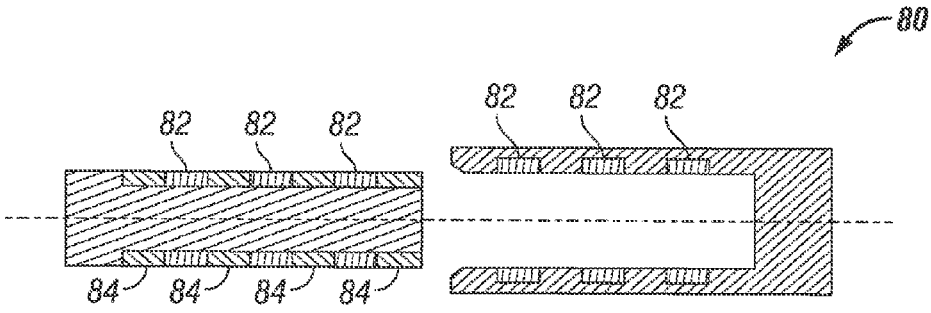
FIG. 7 is a schematic view of an electrical connector according to one or more aspects of the present disclosure.
Figure 8:
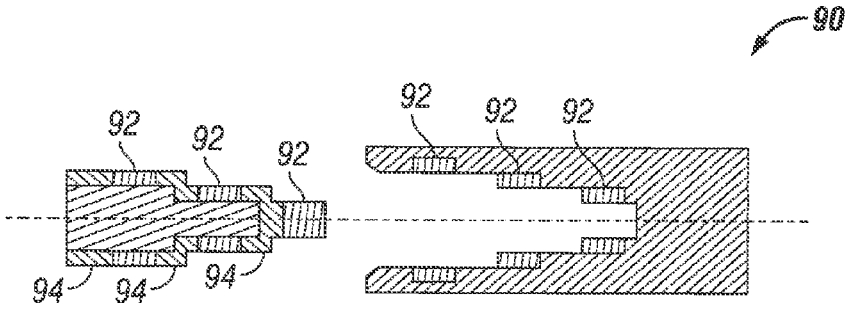
FIG. 8 is a schematic view of an electrical connector according to one or more aspects of the present disclosure.

FIG. 7 shows another connector pair 80 of the present disclosure. This aspect comprises multiple contacts 82 spaced axially on a single diameter separated by insulating seals 84. FIG. 8 shows yet another connector pair 90 of the present disclosure. This aspect also comprises multiple contacts 92 spaced axially and separated by insulating seals 94, but at differing diameters as to increase the short path without increasing the axial distance between conductors.

Returning to FIGS. 3 and 4, the power source 42 section of the power sub 30 may be comprised of single or multiple power sources. These power sources can be divided into two types: energy conversion and energy storage. Energy conversion aspects include, but are not limited to, turbine power converting kinetic energy of the mud flow into electric power, vibrational energy generators, and piezo-electric power conversion. Energy storage aspects include, but are not limited to, batteries (rechargeable downhole or not), ultra-capacitors, fuel cells, and flywheel kinetic energy storage.

Batteries and rechargeable batteries offer a convenient power source for aspects of the present disclosure. Aspects may also be implemented using combinations of power sources. For example, an aspect may be configured for turbine power to provide power during mud flow while battery power is used to provide power with no flow present. The use of turbine or other energy conversion systems allows for aspects to be implemented wherein a battery or other energy storage device is charged downhole. Alternatively, such combinations could be used together to increase the power output of the power sub 30.

In addition to providing power management of the power sources implemented in the power sub 30, aspects of the electronics 44 section are configured to protect against spark and shock risk at the conductors during handling and connection with other tools. Indeed, while the tools shown in FIG. 2 only share power source based on energy conversion (i.e., a turbine) that is inactive during the handling or connection with other tool, the power sub 30 preferably includes a power source based on energy storage (e.g., a battery) that is usually charged before it arrives at the drilling rig. Hence, it may be advantageous to implement one or more safety switches in the power sub 30, as further detailed below. Other functions of the electronics 44 may include sensing, recording and transmitting power system status and diagnostics, both in real time via telemetry means and following an operation from recorded memory. Optional sensors may also be implemented in the electronics 44 section if desired (e.g., annular or stand pipe pressure sensors).

A tiered approach to safety is preferred, as well as the use of automated safety logic. Aspects of the power sub 30 may be implemented with a safety switch. One aspect is configured with the safety switch in the form of a hall effect sensor energized by a magnet and inserted into a read-out-port (ROP) disposed on the sub 30 (See item 45 in FIG. 4) and operable from an exterior of the power sub 30 (e.g., an exterior of the collar 38). In this embodiment, when the magnet is inserted into the ROP 45, the power source 42 is electrically disconnected or de-coupled from the conductors 40, 50 at either end of the tool. It will be understood by one skilled in the art that other means may be used to disconnect the power source 42. For example, an alternative to using a hall effect switch is a mechanical switch that is closed when the power sub 30 is linked into the tools in the assembly (not shown).

In operations, the magnet is removed at the rig, for example once the BHA is assembled, thereby permitting the connection of the power source 42 to one or both connectors 40 and 50. However further control of one or more of the power sources 42 may be achieved, if desired. Once in service downhole, the power source 42 can be switched on or coupled via downlink commands through telemetry means (or direct control via a wired drill pipe system). Such automated switch logic can also be configured for operation when the central chassis 36 is put into the BHA. Safety interlocks can be included for automatic coupling of the power source 42 when mud flow is confirmed. U.S. Pat. No. 6,649,906 (assigned to the present assignee and entirely incorporated herein by reference) describes safety interlock configurations that may be implemented with aspects of the present disclosure. The power source 42 can then remain coupled unless a safety interlock is violated (e.g., a voltage or current limit violation, or a predetermined timeout without mud flow) or a downlink telemetry decoupling command is given.

The electronics 44 of the power sub 30 may be configured to vary the output voltage delivered through the upper 40 and/or lower 46 conductors as needed. The electronics 44 can be implemented with appropriate circuitry to allow on-site programming of the output voltage, increasing the flexibility of the system. Additionally, the electronics 44 can also be used for the purpose of recharging a rechargeable power source 42.

Aspects of the present disclosure may be implemented using multiple power subs 30 in a single assembly. The subs 30 could be used in parallel to increase the power capability of the system or used sequentially to increase the run life (e.g., in the case of an energy storage device). It should be appreciated that, in the configuration shown in FIG. 2, no electrical coupling between two power sources is provided. In contrast, when multiple power subs 30 are coupled to the bus 34 in the BHA, for example a battery and a turbine, it may be advantageous to implement power management systems between the multiples power subs. Thus, the electronics 44 in each sub 30 can be configured to prevent inadvertent charging or discharging of the power source 42 when multiple subs are used in combination.

Aspects of the present disclosure may also be configured with a retrievable power source 42 such that the source (e.g., a battery) could be replaced or initially inserted from the surface, with the BHA in position downhole. One such aspect can be implemented with the chassis 36 and collar 38 incorporating a latching mechanism (See item 49 in FIG. 4) and a modified connector 48 at the upper end thereof. The latching mechanism 49 removably connects the retrievable chassis 36 to the drill collar 38, while allowing for mud flow through the tubular. The modified upper connector 48 can be adapted for connection to a wireline, slickline, or other retrieval mechanisms as known in the art for retrieval of the unit to the surface. The retrievable chassis 36 may also be deployed into the downhole tool or subsurface assembly using a tractor, mud flow, gravity or other conveyance means. The retrievable chassis 36 is then secured in place using the latching mechanism 49. Other retrievable configurations may be devised to implement aspects of the present disclosure. U.S. Pat. No. 6,577,244 and U.S. Patent Publication No. 20060260805 (both assigned to the present assignee and entirely incorporated herein by reference) describe retrievable tool configurations that may be implemented with aspects of the present disclosure.

Figure 9:
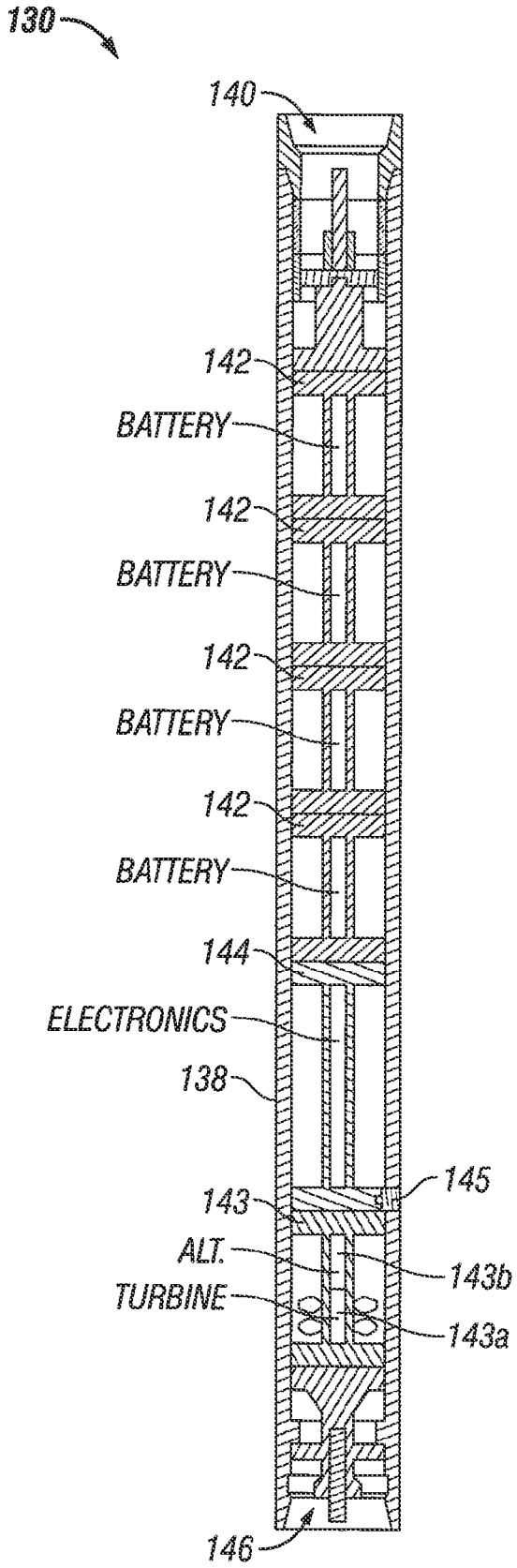
FIG. 9 is a schematic view of a power sub according to one or more aspects of the present disclosure.

FIG. 9 is a schematic view of a power sub 130 according to one or more aspects of the present disclosure. This system configuration includes a centralized power scheme where the modular power sub 130 is disposed in the assembly. One or more aspects of the power sub 130 are or may be substantially similar to corresponding aspects of the power sub 30 described above and shown in other figures. For example, the power sub 130 may include a multiple conductor, high power and communications bus which may be substantially similar in function to the bus 34 described above. The bus may provide redundant electrical paths between the modular power sub 130 and the tools in the BHA to minimize the impact of the failure of one of the paths in the bus. Although aspects of the modular power sub 130 disclosed herein are shown powering the tools of a drill string BHA, one skilled in the art given the benefit of this disclosure will appreciate that the present disclosure is not limited solely to drilling applications.

The modular power sub 130 shown in FIG. 9 may also include a central chassis similar in function to the chassis 36 described above, coupled internally to a main drill collar 138 in a manner which allows mud flow within the annular space between the drill collar 138 and the chassis. However, other configurations within the scope of the present disclosure may have the mud flow through a central channel (not shown) within the chassis. Additionally, other aspects may be implemented with the chassis offset from center of the collar 138.

The chassis may be comprised of four main components, such as an upper conductor module 140, a plurality of rechargeable battery modules 142, an energy conversion module 143, an electronics module 144, and a lower conductor module 146. It is worth noting that the top-to-bottom sequence of these modules is not limited to the embodiment shown in FIG. 9. For example, the electronics module 144 may be positioned above the battery modules 142 and/or below the energy conversion module 143, among other embodiments within the scope of the present disclosure.

The upper 140 and lower 146 conductor modules route power and communication to and from the power sub 130. The upper conductor module 140 may comprise a pin connector and the lower conductor module 146 may comprise a box connector as described with regard to embodiments discussed above. It will be understood that aspects of the power sub 130 can be implemented with the pin and box connectors transposed (i.e., pin at lower position, box at upper position). Moreover, the particular connector pair employed by the upper 140 and lower 146 conductor modules may be any of those described elsewhere herein, conventional, or otherwise.

The power section of the power sub 130 comprises multiple power sources/modules. These power sources can be divided into two types: energy conversion and energy storage. Energy conversion aspects include, but are not limited to, turbine power converting kinetic energy of the mud flow into electric power, vibrational energy generators, and piezo-electric power conversion. In the embodiment illustrated in FIG. 9, for example, the energy conversion module 143 includes a turbine 143*a* configured to be driven by mud flow and cooperate with an alternator 143*b* to convert rotational kinetic energy into electric power. Energy storage aspects include, but are not limited to, batteries (rechargeable downhole or not), ultra-capacitors, fuel cells, and flywheel kinetic energy storage. In the embodiment illustrated in FIG. 9, for example, such energy storage is accomplished via the plurality of rechargeable battery modules 142 which are electrically coupled (at least indirectly) to the energy conversion module 143, such that the rechargeable battery modules 142 may store the energy generated by the energy conversion module 143.

The power sub 130 may also include a safety switch 145. The safety switch may be or comprise a hall effect sensor energized by a magnet and inserted into a read-out-port (ROP) disposed on the power sub 130 and operable from an exterior of the power sub 130 (e.g., an exterior of the collar 138). For example, when the magnet is inserted into the ROP 145, the battery modules 142 and/or energy conversion module 143 are electrically disconnected or de-coupled from the conductor modules 140, 146 at either end of the tool. It will be understood by one skilled in the art that other means may be used to disconnect the power sources 142 and/or 143. For example, an alternative to using a hall effect switch is a mechanical switch that is closed when the power sub 130 is linked into the tools in the assembly (not shown).

The electronics 144 of the power sub 130 may be substantially similar, at least in function, to those describe above, such as being configured to vary the output voltage delivered through the upper 40 and/or lower 46 conductor modules as needed. The electronics 144 can be implemented with appropriate circuitry to allow on-site programming of the output voltage, increasing the flexibility of the system. Additionally, the electronics 144 can also be used in conjunction with recharging of the rechargeable battery modules 142. For example, the electronics 144 may be configured to prevent inadvertent charging or discharging of the battery modules 142 and/or energy conversion module 143, including when multiple subs are used in combination.

The sub 130 may also be configured with retrievable battery modules 142 such that they may be replaced or initially inserted from the surface, with the BHA in position downhole. One such aspect can be implemented with the chassis and collar 138 incorporating a latching mechanism (such as item 49 shown in FIG. 4) and a modified connector at the upper end thereof. The latching mechanism may removably connect the retrievable chassis to the drill collar 138, while allowing for mud flow through the tubular. The modified upper connector can be adapted for connection to a wireline, slickline, or other retrieval mechanisms as known in the art for retrieval of the unit to the surface. The retrievable chassis may also be deployed into the downhole tool or subsurface assembly using a tractor, mud flow, gravity or other conveyance means. The retrievable chassis may then be secured in place using the latching mechanism. Other retrievable configurations may be devised to implement aspects of the present disclosure. U.S. Pat. No. 6,577,244 and U.S. Patent Publication No. 20060260805 describe retrievable tool configurations that may be implemented with aspects of the present disclosure.

It will be appreciated by one skilled in the art that various tool configurations can be implemented using the modular power source techniques disclosed herein. For example, it will be appreciated that the disclosed power sub configurations can be implemented to include conventional sources and sensors to perform a variety of subsurface measurements as known in the art. Though not shown in full detail for clarity of illustration, the disclosed aspects can be implemented with conventional electronics, hardware, circuitry, housings and materials as known in the art. For example, embodiments can be implemented using composite materials to form the chassis and/or housing tubular as known in the art. U.S. Pat. Nos. 6,084,052 and 6,300,762 (both assigned to the present assignee and entirely incorporated herein by reference) describe composite-based tools and tubular configurations that may be implemented with aspects of the present disclosure. It will also be appreciated that aspects of the present disclosure may be used for any subsurface applications requiring a local power source including, but not limited to, LWD/MWD, LWT, run-in tools, production tubing, casing, and underwater applications. For the purposes of this disclosure it will be clearly understood that the word "comprising" means "including but not limited to" and that the word "comprises" has a corresponding meaning.

What is claimed is:

1. An electrical power system, comprising:

a drill collar; and a central chassis internally coupled to the drill collar and configured for interconnection within a subsurface drillstring, wherein the central chassis comprises:

an electrical power unit;

a first conductor operatively coupled to the electrical power unit, disposed within the drill collar at a first end of the drill collar, and configured to distribute electrical power from the electrical power unit to a plurality of separate, modular components coupled to the electrical power system within the subsurface drillstring and housed within one or more additional drill collars; and a physical switch disposed in the drill collar and operable from an exterior of the drill collar for electrically disconnecting the electrical power unit from the first conductor, wherein the physical switch comprises a read-out-port configured to receive a magnet.

2. The electrical power system of claim 1 comprising an annular space between the drill collar and the central chassis, wherein the annular space is configured to allow mud flow to or from at least one component of the plurality of separate, modular components coupled to the electrical power system within the subsurface drillstring.

3. The electrical power system of claim 1 wherein the central chassis comprises at least one electronics component, and a second conductor disposed within the drill collar at a second end of the drill collar and operatively coupled to the electrical power unit.

4. The electrical power system of claim 3, comprising a conductive link coupled, at least indirectly, to at least one of the first and second conductors.

5. The electrical power system of claim 3 wherein one of the first and second conductors comprises a pin conductor and the other of the first and second conductors comprises a box conductor.

6. The electrical power system of claim 3 wherein the central chassis comprises a latching mechanism that enables retrieval of the central chassis from the drill collar while the drill collar is downhole.

7. The electrical power system of claim 1 wherein the first conductor comprises at least one multiple conductor member.

8. The electrical power system of claim 1 wherein the first conductor comprises a plurality of electrical conductors, including at least one first conductor configured for distributing high power and at least one second conductor configured for distributing communications.

9. The electrical power system of claim 1 wherein the first conductor comprises at least two first conductors configured for distributing high power and at least two second conductors configured for distributing communications.

10. The modular power system of claim 1 further comprising an additional switch operable through a telemetry command for electrically connecting the electrical power source to the connector.

11. A modular power system for a downhole tool, comprising:

a tool collar configured to operatively connect to a Bottom Hole Assembly (BHA), wherein the BHA comprises a plurality of separate, modular BHA components housed in one or more additional tool collars;

an electrical power source disposed in the tool collar and configured to provide electrical power to the plurality of separate, modular BHA components;

a first connector disposed within the tool collar at a first end of the tool collar and operatively coupled to the electrical power source to route power and data from the modular power system to an adjacent BHA component housed in the one or more additional tool collars;

a second connector disposed within the tool collar at a second end of the tool collar and operatively coupled to the electrical power source; and a physical switch disposed in the tool collar and physically operable from an exterior of the tool collar for electrically disconnecting the electrical power source from the connector, wherein the physical switch comprises a read-out-port configured to receive a magnet.

12. The modular power system of claim 11 wherein the plurality of separate, modular BHA components includes at least one drilling component.

13. The modular power system of claim 11 wherein the plurality of separate, modular BHA components includes at least one telemetry component.

14. The modular power system of claim 11 wherein the plurality of separate, modular BHA components includes at least one of a measurement-while-drilling (MWD) component and a logging-while-drilling (LWD) component.

15. The modular power system of claim 11 wherein the electrical power source comprises an energy conversion device, and wherein each of the plurality of separate, modular BHA components is powered solely by the electrical power source.

16. The modular power system of claim 11 wherein the electrical power source comprises an energy storage medium which is rechargeable downhole.

17. The modular power system of claim 11, wherein the electrical power source comprises a plurality of rechargeable battery modules and an energy conversion module.

* * * * *